US005781822A

United States Patent [19]

Nishiyama et al.

[11] Patent Number: 5,781,822

[45] Date of Patent: Jul. 14, 1998

[54] IMAGE FORMING APPARATUS PROVIDED WITH IMAGE ERASER

[75] Inventors: Haruo Nishiyama, Nara; Masanori Matsumoto, Kashihara; Shigeru Watase, Yamatokoriyama; Takao Horiuchi, Nara, all of Japan

[73] Assignee: Sharp Kabushiki Kaisha, Osaka, Japan

[21] Appl. No.: 843,846

[22] Filed: Apr. 17, 1997

[30] Foreign Application Priority Data

Apr. 17, 1996 [JP] Japan ..... 8-095323

[51] Int. Cl.[6] ..... G03G 21/00

[52] U.S. Cl. ..... 399/1; 399/390

[58] Field of Search ..... 399/1, 18, 19, 399/20, 390

[56] References Cited

FOREIGN PATENT DOCUMENTS

A 5-289576 11/1993 Japan .
A 7-068994 3/1995 Japan .
A 7-068995 3/1995 Japan .
A 7-092863 4/1995 Japan .
A 7-129045 5/1995 Japan .
7-239576 9/1995 Japan .

*Primary Examiner*—Joan H. Pendegrass

[57] ABSTRACT

To maintain an image eraser used for erasing a toner image printed on a sheet operable wastes power, and additionally, a manual operation is required for loading a sheet feed portion with sheets from which the printed image is removed for reuse. The main body of an image forming apparatus is provided with a tray for image erasure and a feed roller for feeding sheets from the tray. Disposed in a passage for transporting the sheets from the tray is an image eraser comprising a nozzle for applying a treatment for removal of toner, a toner removal roller and a pressure roller and the likes. By means of a transport roller, sheets are transferred from the image eraser to an intermediate tray or a registration roller for feeding sheets to an image forming position. The image eraser is actuated for image erasure while the image forming apparatus is not performing an image forming operation. The sheets from which the image is removed are received by the intermediate tray which, in turn, feeds the sheets for image forming operation if it is determined before execution of the operation that the sheets in the intermediate tray match with a sheet size specified for the operation.

10 Claims, 7 Drawing Sheets

IMAGE FORMING APPARATUS PROVIDED WITH IMAGE ERASER

BACKGROUND OF THE INVENTION

1. Field of the Invention

The present invention relates to an image forming apparatus, and more particularly to an image forming apparatus for forming desired images on sheets, provided with a device for erasing the images formed on the sheets, such as toner images, so as to reuse such sheets.

2. Description of the Related Art

An image forming apparatus for electrophotographically forming images generally performs an image forming operation which comprises the steps of forming a toner image on a photoconductive material as a recording medium, transferring the toner image onto a sheet such as a copy sheet, passing the copy sheet through a fusing device for permanently fixing the toner image on the sheet, and discharging the resultant sheet out of the main body of the apparatus.

Such an image forming apparatus allows desired images to be formed on sheets. In case where the image information on the sheets are confidential documents or the like, the sheets are subject to a shredder to be torn into fine pieces for maintaining the secrecy of the information contained therein when such information is no longer needed. Thus, sheets carrying unnecessary toner images are not reusable, resulting in serious waste of the resources. In addition, the shredder for tearing the sheets into fine pieces is required.

In this connection, there has been proposed a technique for erasing a toner image formed on a sheet thereby rendering the sheet reusable, or for allowing another image to be formed thereon. For, example, disclosed in the Japanese Unexamined Patent Publication JP-A 5-289576(1993) is an image forming apparatus wherein a sheet transport passage includes a device for erasing toner images. More specifically, a sheet with the toner image formed thereon is fed through the sheet transport passage to the image erasing device, as required, so that the toner image is removed from the sheet and the sheet is discharged out of the apparatus for reuse or fed again to an image forming station for image forming operation.

The image erasing apparatus disclosed in the foregoing patent Publication utilizes for image forming a special toner material comprising a coloring agent to be erased by irradiation of light of a specific wavelength such that the resultant image may be erased by irradiating the whole surface of the sheet with the light of the specific wavelength. Accordingly, it is impossible to erase a toner image formed of a general toner material instead of the special toner.

On the other hand, there has been proposed a technique, as typically suggested in Japanese Unexamined Patent Publications JP-A 7-68994(1995) and 7-68995(1995), wherein a treatment for rendering the toner material separable from sheets is previously applied to the sheets so that the toner image may be readily separated from the sheets when the sheets are passed between heat rollers, for example. The heat rollers, in turn, adsorbs the toner material on the surface thereof, thereby removing the toner image from the sheets. This does not require the use of the special toner material, enabling an easy removal of the toner image from the sheets by means of application of the treatment for removing the toner material. The reuse of the sheets is also accomplished in this manner.

Such an arrangement as to utilize the treatment for removing the toner image from the sheets is also disclosed in Japanese Unexamined Patent Publications JP-A 7-92863 (1995) and 7-129045(1995). The arrangement disclosed in JP-A 7-92863(1995), in particular, is characterized in that whether the sheets carry the toner image or not is determined and each sheet is discharged to different places depending upon whether the sheet carries the toner image or not, whereby the subsequent operations are made simple.

The device for erasing the toner image employed by the prior-art image forming apparatuses is capable of erasing a toner image formed of the special toner material but is incapable of erasing a toner image formed of the general toner material.

On the other hand, the device which previously applies the treatment for removal of the toner image provides an easy removal of the toner image from the sheets even if the image is not formed of the special toner material. Hence, the image forming apparatus may incorporate the image erasing device which comprises means for applying the treatment and means for removing the toner image from the sheets.

More specifically, the image forming apparatus may be arranged such that unnecessary copies produced by the apparatus are fed from a dedicated storage bin and a toner remover is applied to the printed surfaces thereof so as to removed the image therefrom when they are passed between the heat rollers However, the prior-art image forming apparatus adapted to erase the toner image, such as proposed in Japanese Unexamined Patent Publication JP-A 5-289576(1993), requires the user to place the apparatus in erase mode for erasing unnecessary toner images. When the image forming apparatus is in the erase mode, the user cannot use the apparatus for forming a desired image.

In addition, the image forming apparatus incorporating the device for erasing the toner image results in increase in the apparatus size and the power consumption. Particularly, a fusing station, a light exposure station and the like consume a considerable amount of power. If the image eraser includes a heat roller, for example, additional power is required for driving the heat roller, which makes it impossible for the image forming apparatus to operate on the standard power supply of 100V, 15A. Hence, a special power supply of 200 V or the like is required.

In order that the image forming apparatus including the image eraser may erase the toner image when required, the heat roller and the like of the image eraser must be constantly maintained at, or above a temperature required for removing the toner material. Hence, a considerable amount of power is wasted while the image eraser does not operate. It is possible to control the heat roller to be actuated when the toner material is to be removed but the heat roller requires a long rise time, leading to a great time loss. Furthermore, the image forming apparatus is not available to the user until the image eraser is ready for the operation, entailing a reduction of time in which the user can use the image forming apparatus. As a result, the essential functions of the image forming apparatus are not efficiently utilized.

As to the image forming apparatus disclosed in Japanese Unexamined Patent Publication JP-A 5-289576(1993), when the apparatus is placed in the toner erase mode, the user desiring to start an image forming operation must wait until the toner erasure operation is completed. Additionally, the apparatus requires the user to set sheets from which the toner image is to be removed, in a required place. The apparatus is provided with an additional sheet feeding tray for receiving and feeding such sheets, resulting in increase in the size thereof.

SUMMARY OF THE INVENTION

In view of the foregoing, it is an object of the present invention to provide an image forming apparatus which is adapted to operate on a predetermined power for power conservation by executing the toner erasure operation when the image forming apparatus is not performing an operation and which allows the essential functions thereof, or the image forming operation, to be preceded.

Another object of the invention is to provide an image forming apparatus which reduces the work of the user for removing the toner and provides an efficient toner erasure operation.

Particularly, it is another object of the invention to provide an image forming apparatus which eliminates a need for an additional portion for receiving sheets through the toner erasure operation by transferring such sheets to an available sheet feeding portion essentially possessed by the image forming apparatus.

For achieving the foregoing objects of reducing the work of the user for erasing the toner image, conserving power and allowing the image forming operation to precede, in particular, the image forming apparatus of the invention adapted to transfer an image formed on a record medium onto a sheet transported to place and to discharge the resultant sheet out of the apparatus, which image forming apparatus comprises a tray for image erasure for receiving unnecessary sheets on which images are formed (hereinafter described as "unnecessary copies", sheet feeding means for feeding the unnecessary copies from the tray for image erasure, an image eraser disposed in a passage for transporting the unnecessary copies fed by the sheet feeding means and erasing the image thereon, idle-period detecting means for detecting a period in which the image forming apparatus is idling; and erasure control means responsive to a detection signal from the idle-period detecting means to actuate the image eraser, to send the unnecessary copies from the tray for image erasure and to execute an image erasure operation.

In case where the image eraser requires a heat source for the image erasure operation, the erasure control means responds to a detection signal from the idle-period detecting means to start supplying power to the heat source while reducing power supply to a high-power consuming portion of the image forming apparatus or shutting off power supply generally to the image forming operation, thereby conserving the power. More specifically, the image forming apparatus is placed into a toner erasure mode when it is not performing the operation, thus executing the image erasure operation At this time, a reduced power is supplied to the high-power consuming portion, such as the heat source of the fusing unit, or no power is supply for the image forming operation for power conservation. Furthermore, the image forming apparatus is allowed to execute the image erasure operation when it is inhibited of the image forming operation. Thus, the image forming apparatus may be automatically shifted into the image erasure mode without interfering with the image forming operation This eliminates the need for the user to perform a cumbersome operation for image erasure.

The above image forming apparatus may further comprise sheet volume detecting means for detecting a volume of sheets contained in the tray for image erasure, such that the erasure control means actuates the image eraser only when the detected sheets exceed a predetermined volume. More specifically, the image eraser is prevented from being actuated with no unnecessary copy to be fed thereto or from being frequently actuated at each detection of one or a few unnecessary copies. The image erasure operation in batches may enhance the effect of power conservation.

For achieving another object of reducing the work on the user aide, the image forming apparatus of the invention adapted to transfer an image formed on the recording medium onto a sheet transported to place and to discharge the resultant sheet out of the apparatus, which image forming apparatus comprises a tray for image erasure which receives unnecessary copies, sheet feeding means for feeding unnecessary copies from the tray for image erasure, an image eraser disposed in a passage for transporting the unnecessary copies fed by the sheet feeding means and erasing the image thereon, and transport control means for sending unnecessary copies to the tray for toner erasure, which unnecessary copies are produced during the image forming operation. P This arrangement reduces the work on the user side. In the occurrence of trouble, such as jam, within the image forming apparatus, the user need not manually remove the jammed sheet and transfer printed sheets, which are not jammed, to the tray for image erasure. In case where a copy suspension key is manipulated when unnecessary copies are produced, the arrangement allows sheets fed into the apparatus to be directly transferred to the tray for image erasure.

The above image forming apparatus further comprises sheet detecting means for detecting the presence of sheets placed on a sheet exit tray of the apparatus, such that when the sheet detecting means detects sheets after lapse of a predetermined period, the sheets on the sheet exit tray may be transferred to the tray for image erasure. If the user leaves unnecessary copies on the sheet exit tray, the unnecessary copies will be transferred to the tray for image erasure of the image forming apparatus and thus, the work on the user side is reduced. In this case, copies discharged before the manipulation of the copy suspension key may also be transferred to the tray for image erasure.

The image forming apparatus of the invention is arranged such that a portion for receiving sheets from which images are removed is not added but such sheets are received by an available sheet feeding portion essentially possessed by the apparatus, from which such sheets are fed for the image forming operation. In case where an intermediate tray is used as the available sheet feeding portion, the intermediate tray normally employed when sheets are subject to the image forming process at least twice, sheets in the intermediate tray are fed to the image forming operation with priority so as to empty the intermediate tray. This brings back the intermediate tray to its normal state in which the intermediate tray serves an operation wherein a sheet is subject to multiple image forming processes.

In case where a sheet size specified for the image forming operation matches with that of sheets from which the image is to be removed, is the intermediate tray contains some of such sheets, the intermediate tray first feeds the sheets for the image forming operation whereas if the intermediate tray contains no such sheets, sheets through the image erasure operation are directly fed to the image forming operation. This provides an effective utilization of the intermediate tray as the sheet feeding tray and also allows the sheets in the tray for image erasure to be directly put to use for the image forming operation.

For achieving the foregoing object of giving priority to the utilization of the image forming apparatus, the image forming apparatus of the invention adapted to transfer an image formed on the recording medium onto a sheet transported to place and to discharge the resultant sheet out of the apparatus, which image forming apparatus comprises a tray for image erasure for receiving sheets of unnecessary copies, sheet feeding means for feeding the unnecessary copies from the tray for image erasure, an image eraser disposed in a passage for transporting the unnecessary copies fed by the sheet feeding means and erasing the image thereon, an intermediate tray for temporarily receiving printed sheets and feeding the received sheets to an image forming position, first transport control means for sending sheets from which images were removed by the image eraser, to the intermediate tray, and control means responsive to a request of forming an image during the image erasure operation for starting the image forming operation while allowing the intermediate tray to hold the sheets therein.

The image forming apparatus of the invention further comprises second control means for the following operation. In case where a sheet size specified for the image forming operation is larger than that of sheets from which images were removed, in the intermediate tray, the control means starts the image forming operation while allowing the intermediate tray to hold the sheets therein. On the other hand, in case where the sheet size specified for the image forming operation is smaller than that of the sheets from which images were removed, in the intermediate tray, the second control means returns the sheets treated by the image eraser to the tray for image erasure. This provides an effective utilization of the intermediate tray serving the operation in which a sheet is subject to multiple image forming processes. In the case of one-sided copies, the intermediate tray is not required and therefore, the treated sheets in the intermediate tray or sheets in other sheet feeding portions may simply be fed for the image forming operation. In case where the intermediate tray is required, as well, the intermediate tray may serve the operation comprising multiple image forming processes on a sheet without entailing reduced efficiency of the utilization thereof.

According to the image forming apparatus of the invention as described in the foregoing, the image erasure operation for removing the image from unnecessary copies for reuse of the sheets is performed while the image forming operation is not carried out. This conserves power as well as provides an efficient utilization of the image forming apparatus without interfering with the ongoing image forming operation.

The sheets from which the image is removed may be selectively transferred to an available sheet feeding portion essentially possessed by the apparatus, such as the intermediate tray serving the operation comprising multiple image forming processes on a sheet, and thus, the treated sheets are readily put to reuse. This eliminates the need for an additional portion for receiving the treated sheets, offering a downsized image forming apparatus.

The image forming apparatus of the invention is adapted to transfer to the tray for toner erasure, unnecessary copies produced during the image forming operation or sheets placed on a specific place, such as the sheet exit tray. This eliminates the manual operation by the user and affords great convenience to the user.

In case where the image forming apparatus runs out of sheets during the image forming operation, the image is removed from unnecessary copies and the sheets are directly committed to the image forming process for restarting the image forming operation. Therefore, a set of image forming operation may be completed without requiring the user to replenish sheets in the course of the operation.

The sheets from which the image is removed are received by the intermediate tray so that the received sheets may be directly committed to the image forming operation. Furthermore, the invention allows the image forming operation to be preceded by way of an effective utilization of the intermediate tray when two-sided copies or composite copies are produced.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
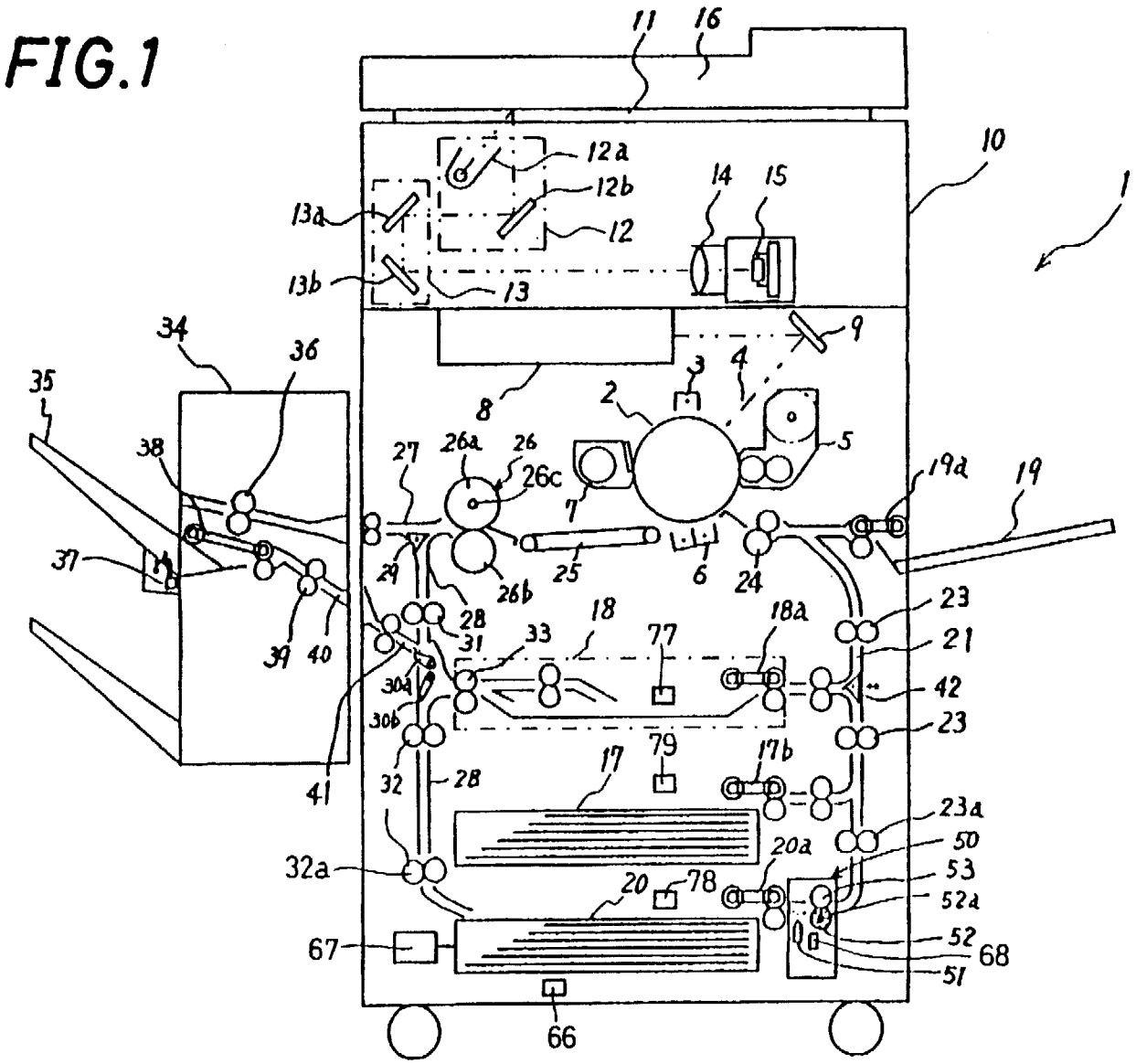
FIG. 1 is a sectional view showing the interior structure of a main body of an image forming apparatus including an image eraser according to the invention.

Now referring to the drawings, preferred embodiments of the invention are described below.

Preferred embodiments of the invention will be described in detail as below with reference to the attached drawings. FIG. 1 is a sectional view showing the interior structure of the whole body of an image forming apparatus including an image eraser for erasing the toner image according to the invention.

Now referring to FIG. 1, description will be given on the image forming apparatus according to the invention. The main body of the image forming apparatus 1 comprises a photoconductor drum 2 as a recording medium which is formed with a photoconductive layer on the surface thereof rotating in the direction shown by the arrow in the figure, a charger 3 for uniformly charging the surface of the photoconductive layer in the rotating direction, an exposure station 4 for exposing the charged surface of the photoconductive layer to a light image so as to form an electrostatic latent image thereon, a development unit 5 for developing the electrostatic latent image with a toner material, a transfer unit 6 for transferring the resultant toner image onto a copy sheet, and a cleaner 7 for cleaning residual toner material after the image transfer processing, the charger 3, exposure station 4, development unit 5, transfer unit 6 and cleaner 7 opposing the photoconductor drum 2, respectively.

The exposure station 4 exposes the surface of the photoconductor drum 2 to a light image of a laser beam from a laser unit 8 via a fixed reflector plate 9. The laser unit 8 controls a semiconductor laser based on data read by a scanner 10 thereabove for reading an original image, thereby forming a light image corresponding to the read data and then, irradiates the surface of the photoconductor drum 2 with the light image thus formed.

The laser unit 8 performs the control based not only on image data supplied by the scanner 10 reading an original document, but also on image data transferred from external equipment. Accordingly, the laser unit 8 is also adapted to receive the image data from the external equipment, such as facsimile machine, personal computer, word processor and the like, to perform the control.

The scanner 10 comprises a first and second scanning sections 12–13 for reading an original document manually or automatically placed on a platen 11 disposed thereabove. The scanner 10 focuses the image scanned by the scanning sections 12–13 on a CCD 15 serving as an image reading device by means of an imaging lens 14. Then, the scanner converts the resultant light image into an electric signal which is outputted as read data. The read data is supplied to an unillustrated image processing unit which, in turn, process the supplied data into image data for controlling the laser of the laser unit 8.

The first scanning section 12 comprises an exposure lamp **12*a* for irradiating the original document with light and a reflection mirror 12*b* and is adapted to travel along the platen 11 in parallel therewith at a predetermined speed of V, for example. The second scanning section 13 comprises reflection mirrors 13*a*–13*b* for directing light reflected from the reflection mirror 12*b* to the imaging lens 14 and is, similarly to the first scanning section 12, adapted to travel along the platen 11 in parallel therewith at a speed of V/2. Thus, the scanner 10 scans the image of the original document on the platen 11 on a line-by-line basis, irradiating the CCD 15** with the scanned image.

The platen 11 is provided with a document feed tray on which document sheets to be read are placed, a document exit tray for receiving document sheets having been read, and an automatic document feeder 16 adapted to feed the document sheets from the document feed tray on a sheet-by-sheet basis, to automatically set the document sheet on the platen 11 and to discharge the document sheet to the document exit tray. The automatic document feeder 16 is adapted for open/close position with respect to the platen 11 such that in the close position, the automatic document feeder 16 goes into automatic feed mode in response to the document sheets placed on the document feed tray, thereby automatically feeding/discharging to/from the platen 11 a document sheet at a time in association with a document reading operation. In the case of document in the form of a book or that which cannot be handled by the automatic document feeder, the automatic document feeder 16 is in the open position so that the document may be manually placed on the platen 11.

The image forming apparatus 1 includes a sheet transport system for feeding a copy sheet to an image transfer position and for discharging the resultant sheet out of the image forming apparatus. Disposed at the image transfer position is the transfer unit 6 for transferring a toner image formed on the photoconductor drum 2 onto the copy sheet. The sheet transport system also includes a transport system for refeeding sheets subjected to the image forming process once, so as to allow an image to be formed on the other side of the sheets or the same side of the sheets.

The main body 1 of the image forming apparatus has at a portion below the image forming station, an automatic sheet feed tray (cassette) 17 containing a multitude of sheets therein, an intermediate tray 18 disposed thereabove for temporarily storing sheets printed on one surfaces thereof and for refeeding the sheets to the image forming station, and a manual feed tray 19 projecting from the right side end of the main body 1 as seen in the figure and allowing manual sheet feeding. The main body 1 of the image forming apparatus further includes a tray for image erasure 20 of the invention, which receives sheets with the toner image formed thereon and feeds the sheets for the erasure of the toner image, when required The automatic sheet feed tray 17, intermediate tray 18 and tray for image erasure 20 are adapted to be drawn out of the main body, rightward as seen in the figure, so that sheets may be replenished or removed whenever it is required.

The automatic sheet feed tray 17, intermediate tray 18, manual feed tray 19 and tray for image erasure 20 are provided with a feed roller **17*a*, 18*a*, 19*a* and 20*a*, respectively, which rollers are selectively controlled. The sheets fed from these trays are transported by means of transport rollers 23, each disposed at a transport passage 21 and a transport passage 22 of the manual feed station, and delivered to a registration roller 24 disposed downstream of a place where the transport passages 21–22** join into one.

The registration roller 24 controllably delivers sheets to the image transfer position in synchronism with the rotation of the photoconductor drum 2, the sheets selectively fed from the automatic sheet feed tray 17, intermediate tray 18 or manual feed tray 19.

The sheet fed by the registration roller 24 is committed to the transfer unit 6 for electrostatical transfer of the toner image formed on the photoconductor drum 2 and then, separated from the surface of the photoconductor drum 2 as carried on a conveyor belt 25 conveying the sheet by suction of the back surface of the sheet. Thus, the sheet is guided to a fusing unit 26, which comprises a heat roller **26*a* containing a heater lamp or the like therein, and a pressure roller 26*b* for pressing the sheet against the heat roller 26*a***.

The fusing unit 26 is provided with a switch member 29 on the discharge side thereof for switching between a sheet exit passage 27 and a sheet return passage 28 depending upon whether the sheet through the fusing unit is discharged out of the image forming apparatus or transported to the intermediate tray 18. In the case where the sheet is transported to the intermediate tray 18, another toner image is formed on the opposite side of the sheet or on the same printed side for multiple times. The sheet return passage 28 terminates at the tray for image erasure 20, delivering thereto sheets with the printed sides down, as required.

At about the midpoint position of the sheet return passage 28, a pair of switch members **30*a*–30*b* are disposed correspondingly to the intermediate tray 18, for switching between two sheet transport directions, to guide the sheets to the intermediate tray 18 or to pass the sheets therethrough. The switch members 30*a*–30*b* are driven independently. The sheet return passage 28 is provided with a transport roller 31 for transporting the sheets and a reversible roller 32 which is adopted to reverse to deliver the sheets to the intermediate tray 18. Directed toward the intermediate tray 18 by the switch members 30*a*–30*b*, the sheets are advanced by a transport roller 33 into the intermediate tray 18 with the printed sides up or down. The transport roller 33** is also reversible.

The sheets guided into the sheet exit passage 27 are delivered to a discharge processing unit 34 having a transport passage correspondingly to the sheet exit passage 27 of the image forming apparatus. The discharge processing unit 34 comprises an unillustrated stapling mechanism adapted to stack discharged sheets in the order of receipt and to perform a stapling process, as required. The discharge processing unit 34 also has a sheet exit tray 35 for receiving batches of stapled copies or copies discharged as they are. The discharge processing unit has a discharge roller 36 in the transport passage thereof for discharging the sheets to the sheet exit tray 35.

The sheet exit tray 35 is provided with a sheet detection sensor 37 for detecting the presence of sheets on the tray 35. The sheet exit tray 35 is also provided with a feed roller 38 and a transport roller 39 for transferring printed sheets from the sheet exit tray 35 to the tray for image erasure 20. Accordingly, the discharge processing unit 34 includes a passage 40 disposed in parallel with the passage having the aforesaid discharge roller 36 and so formed as to communicate with a passage 41 interconnecting the passage 40 and the sheet return passage 28 in the main body of the image forming apparatus.

The passage 41 communicates with the sheet return passage 28, as aforementioned, and is provided with the switch members 30*a*–30*b* for guiding the sheets to the tray for image erasure 20. The switch members 30*a*–30*b* are independently driven and so controlled as to guide the sheets from the sheet exit tray 35 to the tray for image erasure 20. In this case, the sheets are normally stacked on the sheet exit tray 35 with the printed sides up. Therefore, the sheets may be transported by way of the transport passage to the intermediate tray 18 so that the sheets may be reversed in the course of transport to the tray for image erasure 20. More specifically, the sheets are transported from the sheet exit tray 35 through the feed roller 38, the transport roller 39, the passage 41 of the image forming apparatus and the transport roller 33 for delivering the sheets to the intermediate tray 18 but the trailing edges of the sheets are detected before the transport roller 33 so that the transport roller 36 is caused to reverse. Thus, the reversed sheets may be fed to the tray for image erasure 20 through the transport roller 32.

First Embodiment

In the image forming apparatus having the construction of FIG. 1 as described above, an image eraser 50 according to the invention will be described hereinbelow.

The image eraser 50 is adapted to inject through a nozzle 51 a treatment over the printed surface of a sheet thereby rendering the toner separable from the sheet. The treatment is supplied from a treatment reservoir to the nozzle 51 for injections. The method of applying the treatment is not limited to injection through the nozzle 51. Alternatively, an absorbent material is impregnated with the treatment and brought into contact with the surface of the sheet for application of the treatment.

The image eraser 50 further comprises cleaning means including a removal roller 52 which is a heat roller for heating the sheet and removing the image from the printed surface coated with the treatment, and a pressure roller 53 for pressing the sheet against the surface of the removal roller 52. The removal roller 52 contains therein a heater lamp 52*a*, such as a halogen lamp, the power supply to which is controlled so as to maintain the surface of the removal roller 52 at a predetermined temperature.

The feed roller 20*a* opposes the tray for image erasure 20 for feeding sheets from the tray 20 to the image eraser 50. Passed between the removal roller 52 and pressure roller 53, the sheet is advanced into the transport passage 21 and then delivered to the intermediate tray 18 through the transport roller 23*a*, according to this embodiment. Accordingly, the feed roller 18*a* of the intermediate tray 18, the transport roller 23*a* and the like are caused to reverse.

Hence, a switch member 42 for switching the transport passages is disposed at a branch point through which the sheet from the intermediate tray 18 is fed into the transport passage 21. The switch member 42 is switched between places to guide the sheet from the intermediate tray 18 to the registration roller 24, to guide the sheet from the tray for image erasure 20 to the intermediate tray 18 via the transport passage 21 or to guide the sheet from the tray 20 directly to the registration roller 24 via the transport passage 21.

Incidentally, the image erasure mechanism of the image eraser 50 is not the essential prerequisite of the invention and the mechanism known to the art is applicable thereto. There may be employed a structure for applying the treatment for rendering the tone separable, which is illustrated in FIG. 10 shown in Unexamined Japanese Patent Publications JP-A 7-68994(1995) and 7-68995(1995), for example. In case where a toner material which is erased by irradiation of light of a specific wavelength 18 used as a developer, the image eraser may include irradiation means for irradiating the whole surface of the sheet with light of a specific wavelength. In this case, a device disclosed in Unexamined Japanese Patent Publication JP-A 5-289575(1993) may be employed as it is.

Figure 2:
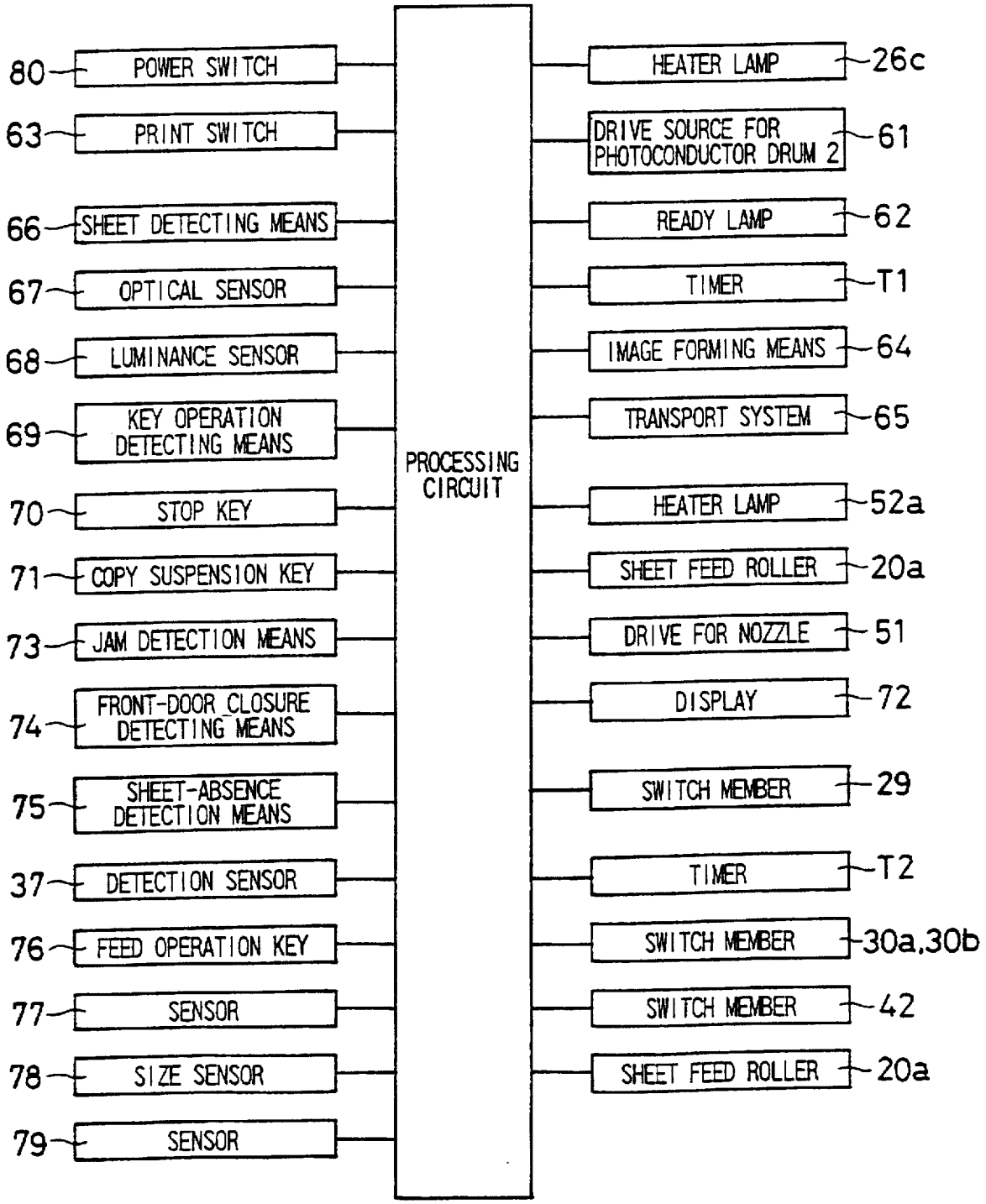
FIG. 2 is a block diagram showing an electric arrangement according to an embodiment of the invention.

FIG. 2 is a block diagram showing the electric arrangement of the embodiment of the invention. A processing circuit 81 realized by a microcomputer or the like is connected with a multitude of switches and sensors and controls the respective components in manners described hereinbelow.

Figure 3:
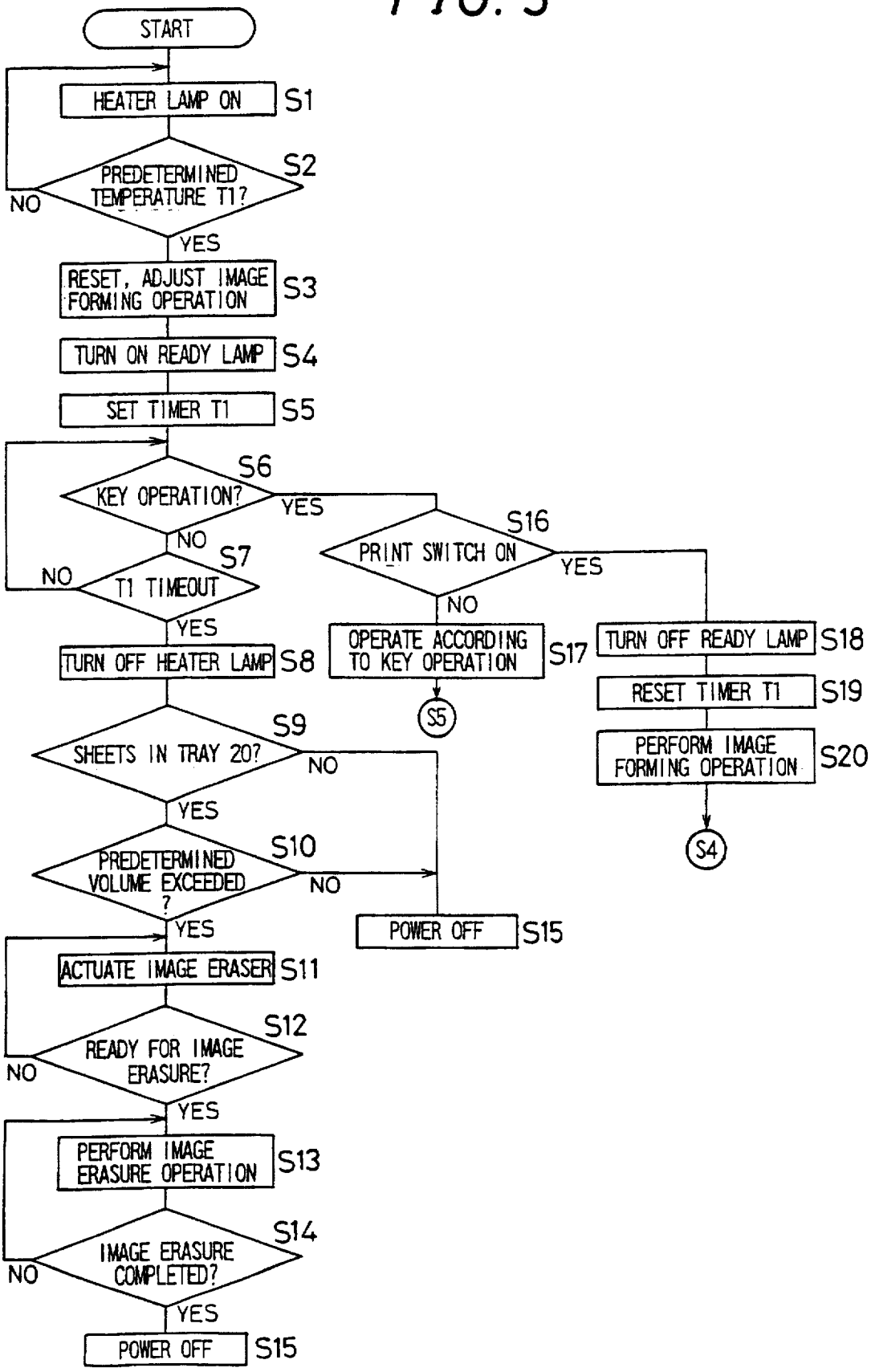
FIG. 3 is a flow chart illustrating an operation for controlling a period of time in which the image eraser is driven according to the invention.

In the above arrangement, the embodiment of the invention will be described with reference to the flow chart of FIG. 3 showing the control steps of the invention.

When a power switch 80 is manipulated to apply power from the main source to the image forming apparatus, steps of FIG. 3 are performed. In response to the power switch, an operation is started to bring the image forming apparatus 1 into a state ready for the image forming operation (ready state) Thus, the heater lamp is actuated to heat the heat roller 26*a* of the fusing unit 26 to a set temperature for fusing the toner into the sheet (Step S1). The heater lamp is controlled until the surface temperature of the heat roller 26*a* of the fusing unit 26 reaches the set level (Step S1–S2).

When the heat roller 26*a* of the fusing unit 26 is heated to the predetermined temperature, a preprocessing for the image forming operation is performed, wherein residual toner and residual potential are removed from the surface of the photoconductor drum 2. More specifically, the photoconductor drum 2 is rotated by a drive source 61 including a motor whereby the whole surface of the photoconductor drum 2 is cleaned by the cleaner 7 while uniformly irradiated with light for removal of the residual potential. Upon completion of reset (Step S3) and adjustment for the image forming operation, a ready lamp 62 indicative of the readiness of the image forming apparatus 1 lights up (Step S4) and a timer T1 is set properly (Step S5). After illumination of the ready lamp 62, a print switch 63 in a control panel is manipulated, thus starting operations from Step S16 through Step S20, wherein the toner image is formed on sheets.

The timer T1 is set to time to place the image forming apparatus in mode of erasing the toner image formed on the sheets. The time is selected from either of the time periods, which include a time period (a) in which the image forming apparatus 1 is idling before the power supply thereto is shut off and a time period (b) in which the power supply to the heater lamp 26C of the fusing unit 26 is reduced to shift the heater lamp into a preheat state. In this state, the heater lamp is maintained at temperatures at which the lamp is not capable of fusing the toner into sheets but soon becomes ready to fuse the toner when the power supply is recovered. In this manner, automatic power conservation is achieved while the image forming apparatus 1 is idling after brought into the ready state.

The timer T1 is set for about 5 minutes, for example. If any one of the keys in the control panel is manipulated before the timer T1 expires, the control operation proceeds from Step S6 to Step S16 to execute an operation in response to the key manipulated (Step S17). If the print switch 63 is manipulated, the control operation proceeds through Steps S18–S19 to cause image forming means 64 to perform the operation (Step S20). Regardless of the print switch 63, the timer T1 is reset at each manipulation of any one of the keys in the control panel, thus repeating time counting.

In case where a copy already exists within the image forming apparatus 1 when the image forming apparatus becomes ready for the operation, the copy is not wanted and therefore, the sheet transport system 65 may be actuated to transfer the unnecessary copy to the tray for image erasure 20 with the printed surface down. In Step S3, the reset may be concurrently performed with heating of the fusing unit 26 (repetition of Steps S1–S2).

In case where after setting of the timer T1, the image forming apparatus is to idle away the time period set by the timer T1 with no operation started in response to any of the keys or the print switch 63, the drive of the heater lamp 26*c* of the fusing unit 26 is stopped (Step S8). Subsequently, the presence of sheets in the tray for image erasure 20 is detected by means of a detection device 66 (Step S9). The technique known to the art is applicable to the sheet detection. In case where the tray 20 is provided with an optical sensor, for example, the presence of sheets in the tray for image erasure 20 may be readily detected by an arrangement wherein an optical path of the sensor is intercepted by the sheet.

If the presence of sheets in the tray for image erasure 20 is confirmed, determination is made on whether the sheets in the tray 20 reach a predetermined volume or not (Step S10). The detection mechanism known to the art is directly applicable to the determination on whether sheets in the tray reach the predetermined volume or not. An easy detection is provided by an arrangement such that sheets stacked on the tray 20 in a predetermined volume may intercept the optical path of the optical sensor 67.

When the presence and volume of sheets in the tray for image erasure 20 are verified, the heater lamp 52*a* contained in the removal roller 52 of the image eraser 50 of the invention is actuated. More specifically, an operation for actuating the image eraser 50 is performed in Steps S11–S12. When a temperature sensor 68 determines that the surface temperature of the removal roller 52 has reached a temperature t2 for removing the toner, the sheets on the tray for image erasure 20 are sequentially fed through the feed roller 20*a* one by one at regular intervals and thus are subjected to the image erasure operation of the image eraser 50 (Step S13).

In the image erasure operation, the treatment for removing the toner is applied to the overall printed surface of the sheet by means of the nozzle 51 and the like, and the sheet is passed between the removal roller 52 and the pressure roller 53 to remove the toner from the sheet, which adheres to the surface of the removal roller 52. The toner adhered to the removal roller 52 is cleaned off therefrom by the cleaning means and the like, so that the removal roller 52 is constantly maintained clean in coming into contact with the printed surface of the sheet. The sheet from which the toner image has been removed is transported to the intermediate tray 18 by the transport roller 23*a*. The operations are repeated until all the sheets in the tray for image erasure 20 are subjected to the image erasure (Steps S13–S14).

In case where the presence of sheets in the tray for image erasure, 20 is not detected or sheets exceeding the predetermined volume are not detected in Step S9 or S10, the power supply from the main source to the image forming apparatus 1 is automatically shut off (Step S15). This contributes to the power consumption. In this case, as described as to the foregoing Step S8, the power supply to the heater lamp 26*c* within the heat roller 26*a* of the fusing unit 26 may be continued for maintaining the surface temperature of the heat roller 26*a* at a relatively low level than required, so that the image forming apparatus 1 may quickly become ready for the operation when the power supply is recovered. Therefore in Step S15, the power supply to the heater lamp 26*c* within the heat roller 26*a* may not be shut off but lowered for maintaining the surface temperature of the heat roller 26*a* at a low level that the toner is not fused. Incidentally, upon completion of the image erasure operation in Step S14, the power supply is similarly shut off and the similar operation to the above is performed on the heat roller. That is, a reduced power may be supplied to the heater lamp 26*c* within the fusing unit 26, which lamp consumes a great amount of power.

Hence, in the fusing unit 26 within the image forming apparatus set in the preheat state, canceling the preheat state may quickly bring the image forming apparatus into readiness for the image forming operation. The cancellation of the preheat state may be triggered in Step S1 of FIG. 3 in response to a signal from key manipulation detection means 69 for detecting the manipulation of any one of the keys in the control panel. Alternatively, the image forming apparatus 1 may be actuated in Step S1 in response to pressing of a preheat cancel key.

In case where a predetermined time period or the time period set by the timer T1 (for 5 minutes according to the embodiment) has expired but the print switch or the like is not manipulated to start the image forming operation while the presence of sheets in the tray for image erasure 20 is verified, the image forming apparatus 1 is automatically placed into an image erasure mode. At this time, the power supply to the heater lamp 26*c* of the fusing unit 26 and the like is stopped or reduced so that the image erasure operation is performed in a power saving manner. The image eraser 50 is supplied with power only in the image erasure mode to avoid power loss. Furthermore, the image erasure operation is performed while the image forming apparatus 1 is idling and therefore, does not require to force the apparatus 1 to stop the operation. Thus is achieved an effective utilization of the image forming apparatus 1.

The image forming apparatus 1 cannot be placed into the image erasure mode in response to detection by the detection device 66 of the presence of sheets in the tray for image erasure 20 if a sensor 67 determines that the sheets do not exceed the predetermined volume (Step S10). This is because heating the heater lamp 52*a* to the predetermined level for the toner removal operation results in time loss rather than time saved by performing the operation on one or a few sheets. In addition, heating the heater lamp at each detection of the presence or sheets will also results in wasted power. Accordingly, the arrangement is made such that the image erasure operation is performed when sheets accumulate to exceed the predetermined volume and thus, both power and time are saved.

In case where the image forming apparatus 1 is allowed to idle for the predetermined time period (for 5 minutes, for example), the image forming apparatus is placed into the image erasure mode. In addition, Step S12 and the subsequent steps may be performed if the presence of sheets in the tray for image erasure 20 is detected before the power supply to the image forming apparatus is shut off. Obviously, the arrangement may be made such that the power supply is shut off when the tray 20 is free of sheets.

Second Embodiment

Next, control for efficiently feeding unnecessary copies to the tray for image erasure 20 will be described by way of an example of a second embodiment of the invention. Particularly when an unnecessary copy is produced, such a copy is transferred to the tray for image erasure 20. This reduces the manual operation of the user.

Particularly when sheet jam occurs within the image forming apparatus 1, the apparatus is adapted to transfer to the tray for image erasure 20 a printed sheet passed through the image transfer position after the jammed sheet is removed. There may also be a case where an image being formed is not actually desired. When an improper document is placed on the platen by mistake, for example, a stop key 70 may be manipulated to suspend the image forming operation of the image forming means 64. In this case, as well, an unnecessary copy may be produced and therefore, such a copy may be sent to the tray for image erasure 20 in the aforementioned manner. This saves the user the time and trouble to manually place unnecessary copies in the tray for image erasure 20 each time the unnecessary copy is produced.

According to FIG. 3, when the detection means 69 detects the manipulation of any one of the keys in the control panel (Step S6), whether or not the print switch 63 is manipulated is determined (Step S16). If it is determined that the print switch 63 is manipulated, the following control steps are performed in accordance with the flow chart of FIG. 4.

In the figure, the ready lamp 62 indicative of the readiness for the image forming operation is shut off in Step S18 followed by Step S19 to reset the timer T1 and then Step S20 to start the image forming operation. In the event of an suspension of the ongoing image forming operation, Step S20 is terminated and followed by Step S21 to determine whether the stop key 70 (suspension key) is manipulated or not. As described in the foregoing, the stop key 70 is used when it is no longer required to continue the present image forming operation. In response to the key 70, the control operation proceeds to Step S30, as will be described hereinbelow, wherein printed sheets are transferred to the tray for image erasure 20.

The image forming operation may be suspended due to other causes than the aforementioned key manipulation. Such causes include jam and other troubles which may occur during the image forming operation. For example, the image forming apparatus may run out of the toner or sheets in the course of the operation. If it is determined in Step S21 that the operation is not suspended by means of the copy suspension key 71, the control operation proceeds to Step S22 where determination is made on whether the image forming operation is completed or not. If the image forming operation is completed, the control operation returns to Step S4 of FIG. 3 for repetition of the aforementioned operations.

If the image forming operation (copy production) is not completed, determination is made on whether the apparatus has run out of sheets or not (Step S23). If the sheet has run out display means 72 prompts the user to replenish sheets of a size required for the operation (Step S24) while the apparatus is on standby until the sheets are replenished (Step S25). Upon verification of the replenishment of the sheets, the control operation may automatically proceed to Step S20 for execution of the image forming operation. However, it is normally arranged to check the manipulation of the print switch 63 and therefore, the control operation returns to Step S4 to wait for the manipulation of the print switch 63. Then responding to the print switch 63, the control operation proceeds to Step S19 which is followed by Step S20 for execution of the image forming operation.

If it is determined in Step S23 that the image forming apparatus has not run out of sheets but jam detection means 73 detects the occurrence of jam in the sheet transport passage, the control operate on proceeds from Step S26 to Step S28 to cause a message display (Step S28) by display means 72 to prompt the user to remove the jammed sheet. Then, the apparatus is on standby until the jammed sheet is removed (Step S29). In case where the image forming operation was not suspended by the occurrence of jam, other trouble is eliminated in Steps S25–S27. After removal of the trouble, the apparatus waits for the manipulation of the print switch 63, resuming the image forming operation in Step S20.

When the image forming apparatus is stopped due to the jam, the front door thereof is opened for removing the sheet jammed in the sheet transport passage. when the jammed sheet is removed, the front door of the apparatus 1 is closed. Responding to a signal from front door detection means 74 detecting the closure of the front door, detection means 75 determines whether the jammed sheet is removed or not and whether sheets other than the jammed sheet exist in the transport passage. If such sheets exist, the sheets are transferred to the tray for image erasure 20. In this case, a sheet before the image transfer position may also be transferred to the tray 20. Alternatively, the sheet before the image transfer processing may be directly delivered to the sheet processing unit 34.

In case where, except for a jammed sheet, a sheet remaining in the sheet transport system of the image forming apparatus 1 is transferred to the tray for image erasure 20, the switch member 29 is switched to posit on to open the sheet return passage 28 so that the sheet is transported through the sheet return passage 28 with the attitude thereof maintained as it is. That is, the sheet is not reversed. Accordingly, the switch members **30*a*–30*b* are controlled for transport of the sheet as it is, whereby the sheet is delivered to the tray for image erasure 20** with the printed surface down.

When after removal of the jammed sheet, the presence of the remaining sheets are detected and then all such sheets are transferred to the tray for image erasure 20 (Step S31), as mentioned in the foregoing. Judgment is made on whether the image forming operation is to be continued or not. In the case of detection of the occurrence of jam by the jam detection means 73, in particular, the control operation may automatically returns to Step S19 after the removal of the jam so that the image forming operation before the occurrence of the jam may be automatically resumed. On the other hand, in case where the image forming operation was suspended by means of the copy suspension key 71, the control operation may return to Step S4 of FIG. 3 but not to Step S19 so as to respond to the operation of the user.

Since unnecessary copies may automatically be delivered to the tray for image erasure 20 in the event of jam, as mentioned in the foregoing, the user is saved of time and trouble to manually place the unnecessary copies in the tray 20 and besides the wasteful use of sheets is avoided. More specifically, the unnecessary copies are received by the tray for image erasure 20 such that the image forming apparatus is placed into this image erasure mode while the apparatus is idling, as mentioned by way of FIG. 3 thereby removing the unnecessary toner image therefrom and putting the treated sheets to reuse. Furthermore, when the user notices during the operation that unnecessary copies are produced, printed sheets in the sheet transport passage of the image forming apparatus 1 may be transferred to the tray for image erasure 20 and thus, a similar effect to the above can be achieved.

According to the embodiment of the invention, the image forming apparatus is adapted to automatically transfer unnecessary, transportable copies to the tray for image erasure 20 if the ongoing image forming operation is caused to stop for some reason. In other cases than the above, the unnecessary copies may automatically be transferred to the tray 20. The following mode of FIG. 4 is arranged such that whether discharged copies are wanted or not is determined and if it is determined that the copies are not wanted, the copies are transferred to the tray for image erasure 20.

Figure 5:
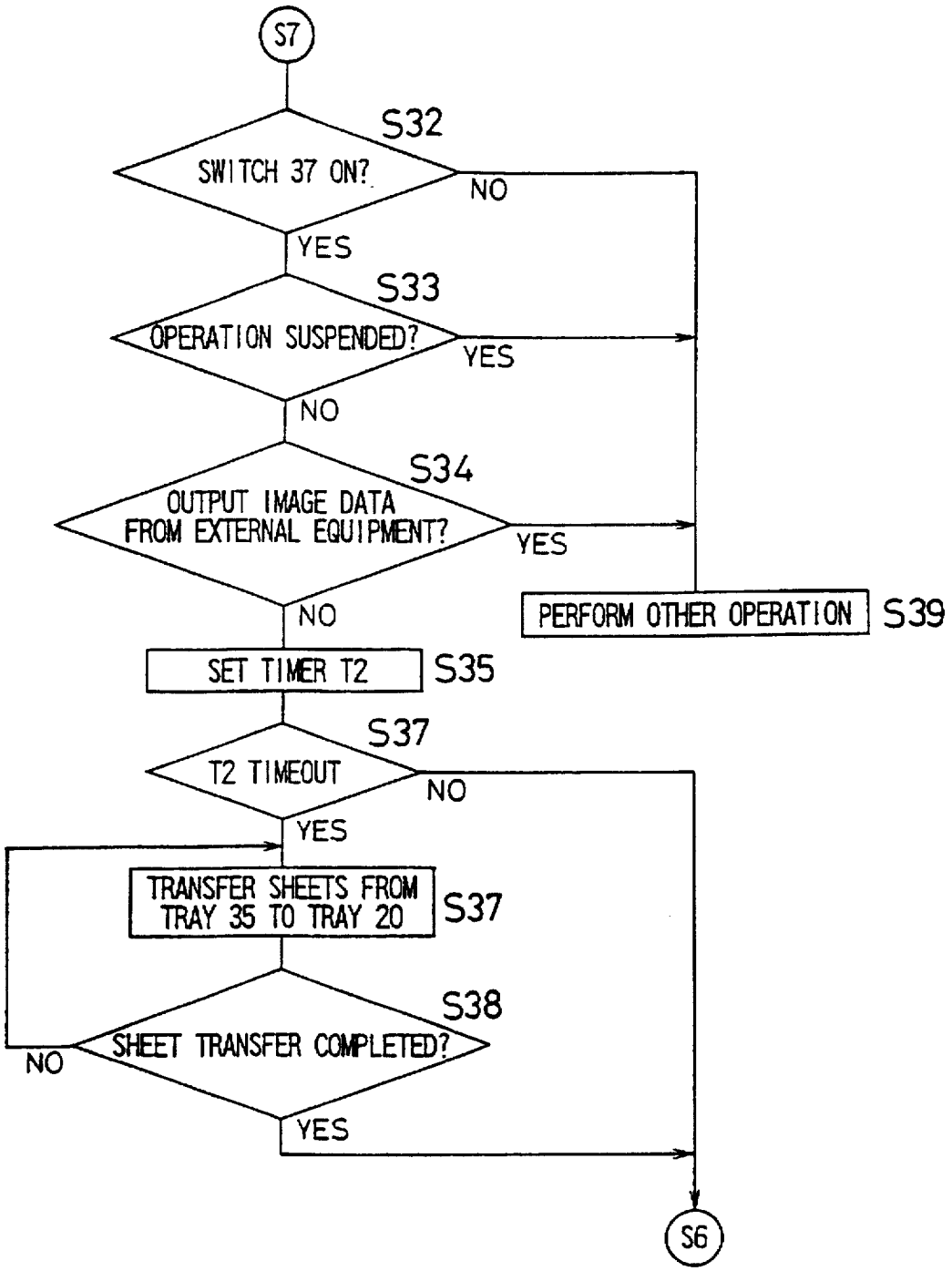
FIG. 5 is a flow chart illustrating another control steps of the invention for transporting unnecessary copies to the tray for image erasure.

FIG. 5 shows a flow chart illustrating the control steps according to the mode. Particularly, the control steps of FIG. 5 are sequentially performed during the execution of Step S7 to determine whether, after setting of the timer T1 in FIG. 3, a time period set by the timer T1 has expired or not.

First, whether sheets are present on the sheet exit tray 35 or not is determined from a signal from the sheet detection sensor 37 (Step S32). If the detection sensor detect no sheet, an operation other than sheet delivery to the tray for image erasure 20 is performed (Step S39). In such an operation, the manipulation of any one of the keys in Step S6 is checked, for example. If the sheet detection sensor 37 detects sheets on the sheet exit tray, whether the ongoing image forming operation is suspended or not is determined (Step S33)). For this determination, the control operation returns to Step S20 of FIG. 4. If the ongoing image forming operation is suspended, the other operation is performed during the suspension (Step S39). In case where the cause for the suspension is not sheet jam, running out of sheets or the like, the control operation proceeds to the subsequent Step S34 while the apparatus is on standby and then, determines whether the discharged sheets are copies of a document or not. That is, determination is made on whether or not the discharged sheets are copies produced from a facsimile machine or the like incorporated in the image forming apparatus.

Figure 4:
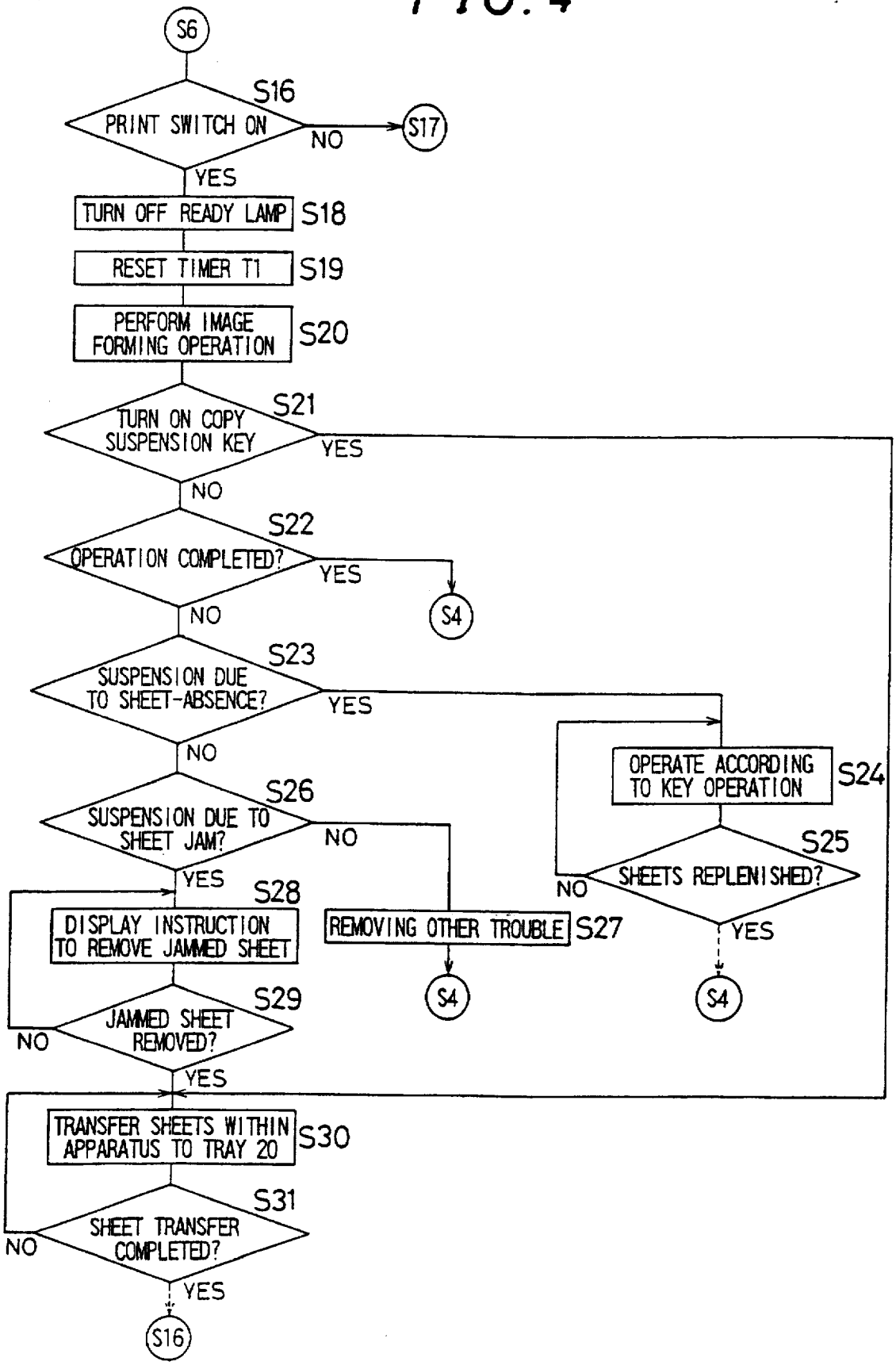
FIG. 4 is a flow chart illustrating control steps of the invention for transporting to a tray for image erasure, unnecessary copies which are produced during an image forming operation and subjected to an image erasure operation.

In case where the image forming operation is suspended by the manipulation of the copy suspension key 71 according to FIG. 4, the control operation proceeds from Step S33 to S34. When the user operates the copy suspension key 71, the user does not want the discharged copies and leaves them. If the user needs the copies, the user will take the copies discharged on the sheet exit tray 35 upon completion of the image forming operation. Accordingly, if the discharged copies are left on the sheet exit tray 35 for a long time after the manipulation of the copy suspension key 71, such copies may be treated as unnecessary copies.

The image forming apparatus 1 is adapted to arbitrarily form an electrostatic latent image on the photoconductor drum 2 by driving the laser unit 8 included in the image forming means 64. Therefore, the image forming apparatus operates not only as a copier for reading an image of a document and forming the image thus read, but also as an output device, which responds to image data transmitted from unillustrated external equipment for producing copies corresponding to the received image data by means of control of the laser unit 8. The image forming apparatus is adapted to receive image data transmitted from a facsimile machine, personal computer or word processor, for example, and to produce copies corresponding to the received image data. In this case, the user may often be away from the site of the image forming apparatus 1. Hence, if it is determined that the image forming apparatus has produced copies of transmitted data, the image forming apparatus performs another operation (Step S39) because the discharged copies are needed.

Copies discharged on the sheet exit tray 35 are not needed if the image forming operation is not suspended, data from the facsimile are not outputted as hard copies, or the user is not at the site of the image forming apparatus 1. For confirmation of the unnecessary copies, the timer T2 is set for a predetermined period t2 (Step S35). If it is determined from a signal from the sheet detection sensor 37 that the copies have not been removed from the sheet exit tray 35 within the period t2 set by the timer T2, then the copies are considered to be unnecessary. In case where the image forming apparatus 1 is on standby or particularly allowed to stand in a state ready for the image forming operation with sheets held on the sheet exit tray 35 longer than the time period t2, the sheets may be judged to be unnecessary. Since sheets through the image forming operation are discharged on the sheet exit tray 35 and removed by the user upon completion of the operation, the resultant copies do not normally stay on the tray 35 for a long time. Hence, no problem exists in deciding that copies staying on the sheet exit tray 35 for a long time are not needed.

In the case of suspension of the image forming operation, however, some copies are already discharged on the sheet exit tray 35. In this case, the control operation proceeds from Step S33 to Step S39, instead of S37, for execution of another operation.

If the copies on the sheet exit tray 35 are detected by the, sheet detection sensor 37, in Step S37, after lapse of the period t2 set by the timer T2, the copies are judged to be unnecessary and then is automatically started an operation for transferring the unnecessary copies to the tray for image erasure 20. Accordingly, unnecessary copies left on the sheet exit tray 35 may be automatically transferred to the tray for image erasure 20 when the copies are judged to be unnecessary based on the lapse of the predetermined period t2. In this case, the control panel may be provided with an additional operation key 76 for transferring unnecessary copies to the tray 20, such that in response to the key 76, a transfer of unnecessary copies from the sheet exit tray 35 to the feed tray for toner erasure 20 may be immediately started.

When after the transfer of the unnecessary copies from the sheet exit tray 35 to the tray 20 (Step S38), the period set by the timer T1 in Step S7 of FIG. 3 has expired, then the image forming apparatus is placed into the image erasure mode for performing the image erasure operation.

According to the above mode, unnecessary copies on the sheet exit tray 35 may be transferred to the tray for image erasure 20, as required. This eliminates the need for the user to pull out the tray for image erasure 20 toward the user for shuffling the unnecessary copies from the sheet exit tray 35 to the tray 20. In addition, the unnecessary copies on the sheet exit tray 35, which are so determined based on the lapse of the time period t2, may be automatically transferred to the tray 20 and therefore, even copies discharged by the manipulation of the copy suspension key 71 may be automatically transferred from the sheet exit tray 35 to the tray for image erasure 20. Hence, when the copy suspension key 71 is manipulated, the control operation need not switch to transport of sheets within the image forming apparatus 1 to the tray for image erasure 20 but the sheet transport system may continue to transport the sheets within the apparatus to the sheet exit tray 35, from which the sheets are transferred to the tray for image erasure 20.

For transfer of an unnecessary copy from the sheet exit tray 35 to the tray for image erasure 20, the unnecessary copy is first transported toward the intermediate tray 18 by means of switch members 30*a*–30*b* switched to proper positions and the feed roller 38, transport roller 39 and the transport roller 33 in the image forming apparatus 1. Upon detection of the trailing end of the sheet before the transport roller 33, the transport roller 32 is reversed to guide the unnecessary copy toward the sheet return passage 28 via the switch member 30*b*, whereby the sheet is delivered to the tray for image erasure 20 by means of the transport roller 32. Thus, the sheet discharged with the printed surface up is delivered to and received by the tray for image erasure 20 with the printed surface down.

In another mode for transferring unnecessary copies to the tray for image erasure 20 for the removal of the toner image, sheets received by and remaining in the intermediate tray 18 are transferred to the tray 20. More specifically, in the production of two-sided copies (or composite copies), sheets printed on one side thereof are temporarily received by the intermediate tray 18.

A case where the sheets are subject to at least two image forming processes for production of two-sided copies or one-sided composite copies will hereinafter be referred to as "production of two-sided copies or the like" for simplicity of the description. If, in such a case, the number of two-sided copies or composite copies to be produced is changed while the sheets are fed from the intermediate tray 18 for the second or the subsequent image forming process or two or more sheets are delivered to the intermediate tray 18 at a time, sheets printed on one side thereof are left in the intermediate tray 18 after completion of the copy production.

When the production of composite copies is interrupted by an operation for forming another image, the user may often forget to remove printed sheets from the intermediate tray 18. In this case, sheets left in the intermediate tray 18 after completion of the image forming operation are considered to be unnecessary, thus transferred to the tray for image erasure 20. If sheets in the intermediate tray 18 are wanted, the user will pull out the intermediate tray 18 for collecting the sheets or take steps to resume the operation for producing the two-sided copies or composite copies. If the user forgets to perform such an operation and such sheets left in the intermediate tray 18 are detected after lapse of a predetermined period of time, transfer of the sheets from the intermediate tray 18 to the tray for image erasure 20 may prove to be highly effective.

As to the image forming operation using the intermediate tray 18, the prior-art arrangement is made such that when sheets left in the intermediate tray 18 are detected, the user is prompted to remove the sheets from the intermediate tray 18. In contrast, the invention is arranged such that the sheets left in the intermediate tray 18 are detected by a sensor 77 and transferred to the tray for image erasure 20 in the aforementioned manner for starting another image forming operation.

In order to transfer the sheets from the intermediate tray 18 to the tray for image erasure 20, the switch member 42 is controlled for opening the transport passage interconnecting both the trays.

Third Embodiment

According to the foregoing embodiment, the image forming apparatus is automatically placed into the image (toner) erasure mode while the apparatus is idling, so that the power consumption is reduced. At the same time, unnecessary copies are automatically transferred to the tray for image erasure 20.

The third embodiment of the invention pertains a mode of control operation to be performed when an operation for execution of the image forming operation is performed during the execution of the image erasure operation in the image erasure mode. According to the invention, the image eraser 50 is incorporated in the image forming apparatus 1 and adapted to operate when the image forming operation is not performed. Therefore, the priority must be placed on the image forming operation. Since the image forming operation cannot be started during the operation of the image eraser 50, the operation of the image eraser 50 is suspended in response a command to start the image forming operation. This provides an efficient utilization of the essential functions of the image forming apparatus 1.

The essential functions of the image forming apparatus 1 include a copy function of reading image of a document and forming the read image on a sheet as a reproduced image, and an output function of receiving image data transmitted from the external equipment, such as facsimile machine, personal computer and the like, and outputting the image data as hard copy, as described in the foregoing. Hence, the image forming apparatus is adapted to respond to the manipulation of the print switch or an output request from the external equipment thereby executing the image forming operation.

Figure 6:
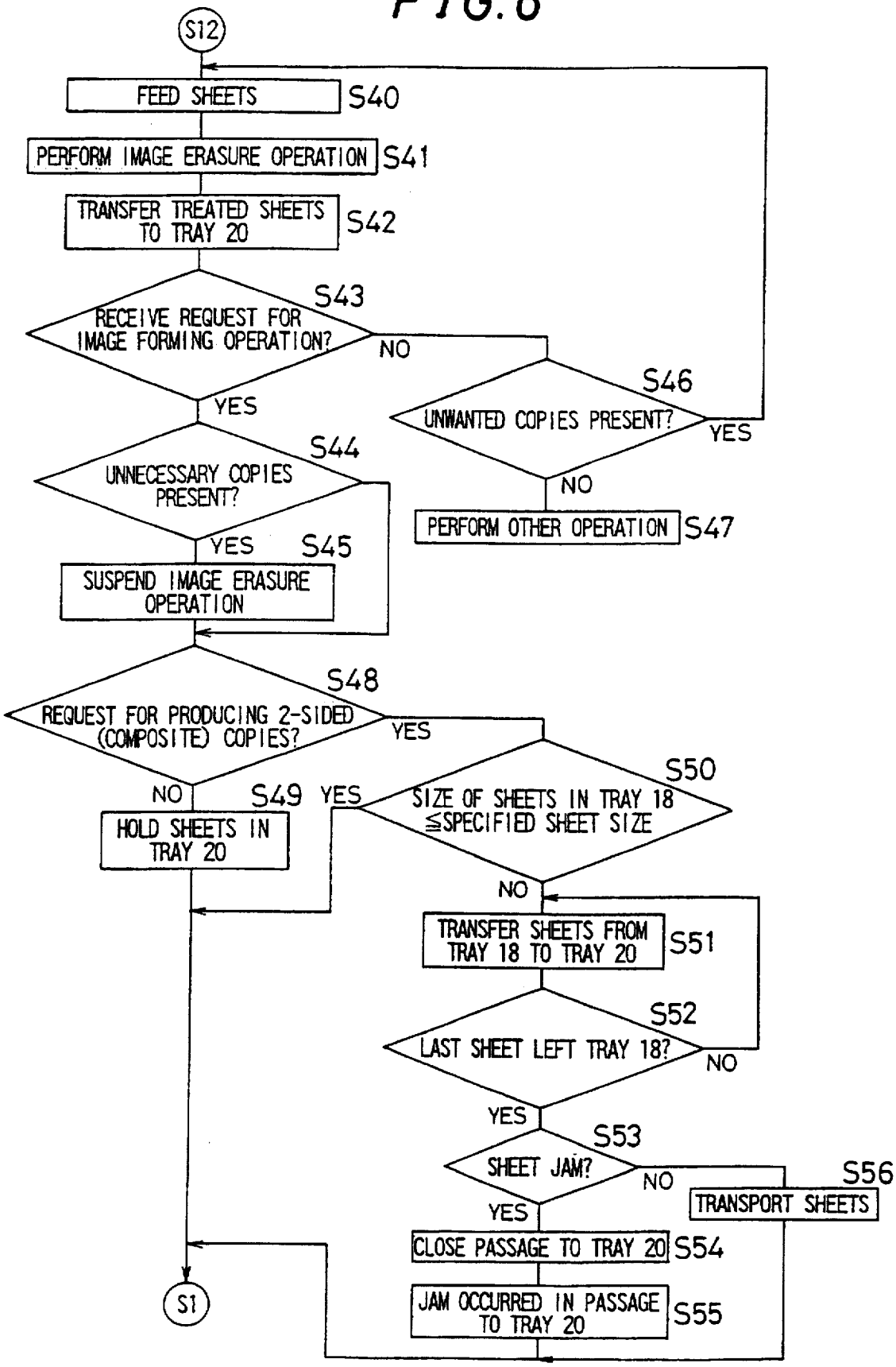
FIG. 6 is a flow chart illustrating control steps of the invention for causing the image forming apparatus to execute the image forming operation with priority during the image erasure operation.

FIG. 6 shows a mode of control steps for this purpose. FIG. 6 is a flow chart showing the details of Steps S13–S14 of FIG. 3 as well as a control operation for giving precedence to the image forming operation.

When the temperature sensor 68 detects the surface temperature of the removal roller 52 of the image eraser 50 reaching a predetermined level, the control operation proceeds from Step S12 of FIG. 3 to Step S40 of FIG. 6. In this step, the feed roller 20*a* is driven to feed unnecessary copies in the tray for image erasure 20 to the image eraser 50, where the unnecessary copies are subject to the image erasure operation (Step S41). Subsequently, the sheets from which the toner image has been removed are delivered to the intermediate tray 18 (Step S42). During this operation, whether a command to start the image forming operation is issued or not is determined in Step S43. More specifically, the manipulation of the print switch 63, receipt of a request for outputting hard copies from the external equipment, and the like are checked, as described in the foregoing.

In case where the image forming operation is not started after the confirmation, the presence of sheets in the tray for image erasure 20 is detected by the sensor 66 (Step S46). If sheets in the tray 20 are detected, the control operation returns to Step S40 so that the foregoing operations are sequentially repeated on a sheet-by-sheet basis. If sheets in the tray 20 are not detected in Step S46, an operation other than the image erasure is performed (Step S47). That is, all the sheets in the tray for image erasure 20 have been treated. As the other operation than the image erasure in Step S47, Step S15 of FIG. 3 may be performed for automatically shutting off the power supply to the image forming apparatus.

When, the command to start the image forming operation is received in Step S43 during the image erasure operation, the image erasure operation is temporarily suspended (Step S45) if the sensor 66 detects sheets in the tray for image erasure 20 (Step S44). If the sensor 66 does not detect the sheets therein, the image erasure mode is automatically canceled to switch the image forming apparatus from the image erasure mode to the image forming mode. Accordingly, the control operation returns to Step S1 of FIG. 3 in which the heater lamp 26C in the heat roller **26*a* of the fusing unit 26 is actuated. When the surface temperature of the heat roller 26*a*** rises to the level to fuse the toner, the control operation skips from Step S16 to S18 so as to execute the image forming operation in Step S20.

Particularly, the efficient utilization of the essential functions of the image forming apparatus 1 can be achieved by the command to start the image forming operation not only through the print switch 63 but also based on the receipt of an output request signal from the external equipment. In this case, if the fusing unit 26 is maintained in the preheat state when the apparatus 1 is placed into the image forming mode, the fusing unit 26 may become ready for fusing the toner in a shorter time, thus allowing quick start of the image forming operation.

The arrangement is made such that while the image eraser 50 is removing the toner image from the sheets, the treated sheets are transferred to the intermediate tray 18 for temporary storage. On the other hand, when the intermediate tray 18 is used for an image forming operation, such as production of two-sided copies or the like, printed sheets are temporarily received by the intermediate tray 18. This leads to a fear that the printed sheets for two-sided copies may become indistinguishable from the sheets from which the toner is removed. However, the following operation ensures that the printed sheets for two-sided copies are separated from the sheets from which the toner is removed.

More specifically, after suspension of the image erasure operation in Step S45, whether the treated sheets were one-sided copies or not is determined (Step S48). If the treated sheets were one-sided copies and the image forming operation to be started is not for the production of two-sided copies or the like, then the image forming operation is started returning to Step S1) while the intermediate tray 18 keeps holding the treated sheets therein (Step S49).

If a command to produce two-sided copies is issued, the control operation proceeds from Step S48 to Step S50 to determine whether or not sheets selected for the image forming operation are larger in size than the treated sheets held in the intermediate tray 18. More specifically, the maximum size of the treated sheets is detected by a size sensor 78. The size SZ1 of the treated sheets detected by the size sensor 78 is compared with that SZ2 of sheets to be subjected to the production of two-sided copies or the like. If $SZ1 \leqq SZ2$, sheets printed on one side thereof may be delivered to the intermediate tray 18 and assuredly aligned with each other laterally and in the sheet feeding direction without interference of the treated sheets held in the intermediate tray 18. Therefore, the image forming operation may be started while the intermediate tray 18 may keep holding the sheets to be treated therein (Step S49). According to the figure, the control operation does not proceed by way of Step S49, but the image forming apparatus starts the image forming operation with the treated sheets held in the intermediate tray 18. Incidentally, first control means controls the transfer of the treated sheets to the intermediate tray 18.

If $SZ1 > SZ2$, the treated sheets in the intermediate tray 18 must be transferred somewhere else. In this case, the user may be prompted to remove the treated sheets from the intermediate tray 18 while the image forming operation is prohibited until the treated sheets are removed.

According to the mode of the invention, the treated sheets are returned to the tray for image erasure 20 so as to eliminate the need for the user to remove them manually. For this purpose, the feed roller **18*a* is driven and the feed roller 20*a* is reversed so as to transfer the treated sheets to the tray for image erasure 20 via the switch member 42. In this association, a transport roller 32*a* is adapted to reverse, as well. Similarly, the removal roller 52 and pressure roller 53 also serving as transport means in the image eraser 50** are adapted to reverse.

This operation is continued until the sensor 77 detects the transfer of the last sheet in the intermediate tray 18 (Step S52) to which the start of the image forming operation is timed. This contributes to reduction in standby time of the user. Second control means controls the transfer of the treated sheets from the intermediate tray 18 to the tray for image erasure 20.

During the operation for transferring the treated sheets from the intermediate tray 18 to the tray for image erasure 20, heating the fusing unit 26 is already started when the control operation proceeds from Step S44 to S45. Accordingly, the image forming Apparatus may become ready for the image forming operation during the transfer of the treated sheets from the intermediate tray 18 to the tray 20. Therefore, when the sensor 77 detects the transfer of the last sheet in the intermediate tray 18, the control operation may return to Steps S18–S20 for starting the image forming operation.

In case where toe jam detection means 73 detects jam (Step S53) after the trailing end of the last sheet left the intermediate tray 18, the intermediate tray 18 is available and therefore, the start of the image forming operation is not prohibited. This is because the jam does not interfere with the transfer of sheets from the intermediate tray 18 to the image forming position when the intermediate tray 18 is used for the production of two-sided copies (or composite copies). At this time, the switch member 42 is switched to position to open the passage interconnecting the intermediate tray 18 and the registration roller 24 (Step S54) while a message is displayed indicating that the treated sheet is jammed in the transport passage to the tray for image erasure 20. The message may be displayed after completion of the production of two-sided copies or the like (Step S55). If the jam of the last sheet is not detected in Step S53, the sheet transfer operation is continued (Step S56) while the switch member 42 is switched to position to close the passage interconnecting the intermediate tray 18 and the tray 20 for opening the passage interconnecting the intermediate tray 18 and the registration roller 24.

Figure 7:
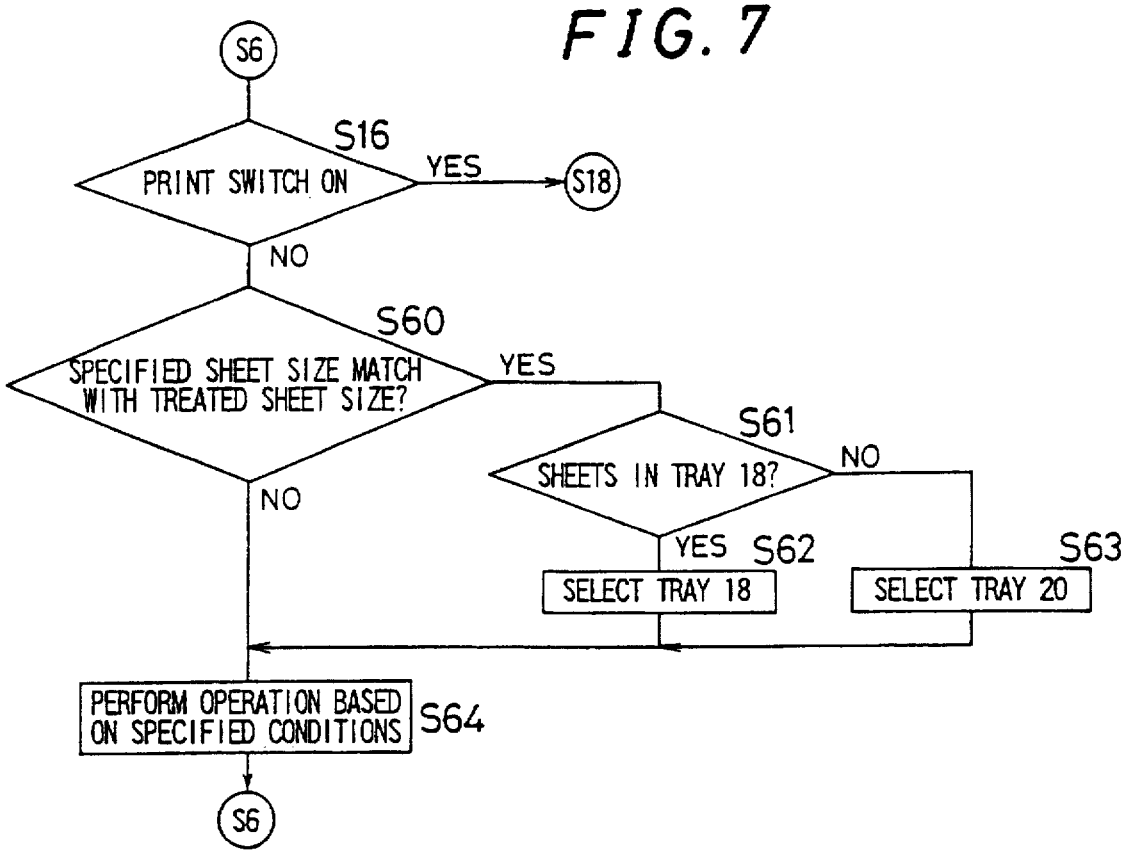
FIG. 7 is a flow chart illustrating control steps of the invention for selecting a sheet feeding portion containing treated sheets with priority.

FIG. 7 is a flow chart illustrating a control operation in case where the user desires to execute the image forming operation during the image erasure operation in the image erasure mode and inputs the image forming conditions and the like by means of keys in the control panel prior to the print switch. In response to the key operation by the user, the control operation is carried out to automatically switch the apparatus from the image erasure mode to the image forming mode and particularly to feed the treated sheets held in the intermediate tray 18 with priority. More specifically, when the treated sheets in the intermediate tray 18 are of a size specified for the image forming operation by means of the key operation, the sheets in the intermediate tray 18 are first fed for the image forming operation. Such an image forming operation is limited to the production of one-sided copies.

The control operation of FIG. 6 is executed in response to the operation of the keys in the control panel during the image erasure operation according to FIG. 3 which keys include the print switch for starting the image forming operation. In response to the manipulation of any one of the keys except for the print switch, the image erasure mode is first canceled. Then in Step S16, whether the print switch 63 is manipulated or not is determined. If the print switch 63 is not manipulated, comparison or sheet size is conducted between a sheet specified in Step S60 and a sheet from which the image is removed.

In this case, if it is determined that the image erasure operation is underway and some treated sheets are received by the intermediate tray 18, the size of the treated sheets in the intermediate tray is compared with the specified sheet size (Step S60). At this time, the size sensor 78 detects the size of the treated sheets in the intermediate tray 18. Subsequently, the detected size is compared with the sheet size specified prior to the print switch (Step S60). If the detected size matches with the specified sheet size, the presence of the sheets in the intermediate tray 18 is checked so as to first feed the treated sheets in the intermediate tray 18 (Step S61). If the treated sheets therein are detected, the intermediate tray 18 is selected for sheet feeding (Step S62) and the setting is made according to the image forming conditions specified by means of the keys (Step S64).

In case where the specified sheet size for the image forming operation does not match with the size of the sheets to be treated, sheets of a proper size may be fed from the sheet feed tray 17 and then the setting is made in Step S64 according to the conditions specified by means of the keys.

If it is determined in Step S61 that the intermediate tray 18 contains no treated sheets, then the tray for image erasure 20 is selected, for example. In this case, the image eraser 50 must be actuated. More specifically, sheets from which the toner is removed are directly fed to the image forming position or to the registration roller 24, rather than to the intermediate tray 18, so that the sheets are subject to the image forming operation according to the conditions specified in Step S64.

With this arrangement, the sheets from which the toner is removed are transferred to the intermediate tray 18 which, in turn, may be emptied by feeding the sheets therefrom, and thus, the production of two-sided copies may be executed at any time required. Additionally, there is no need to transfer the treated sheets from the intermediate tray 18 to the tray for image erasure 20.

Figure 8:
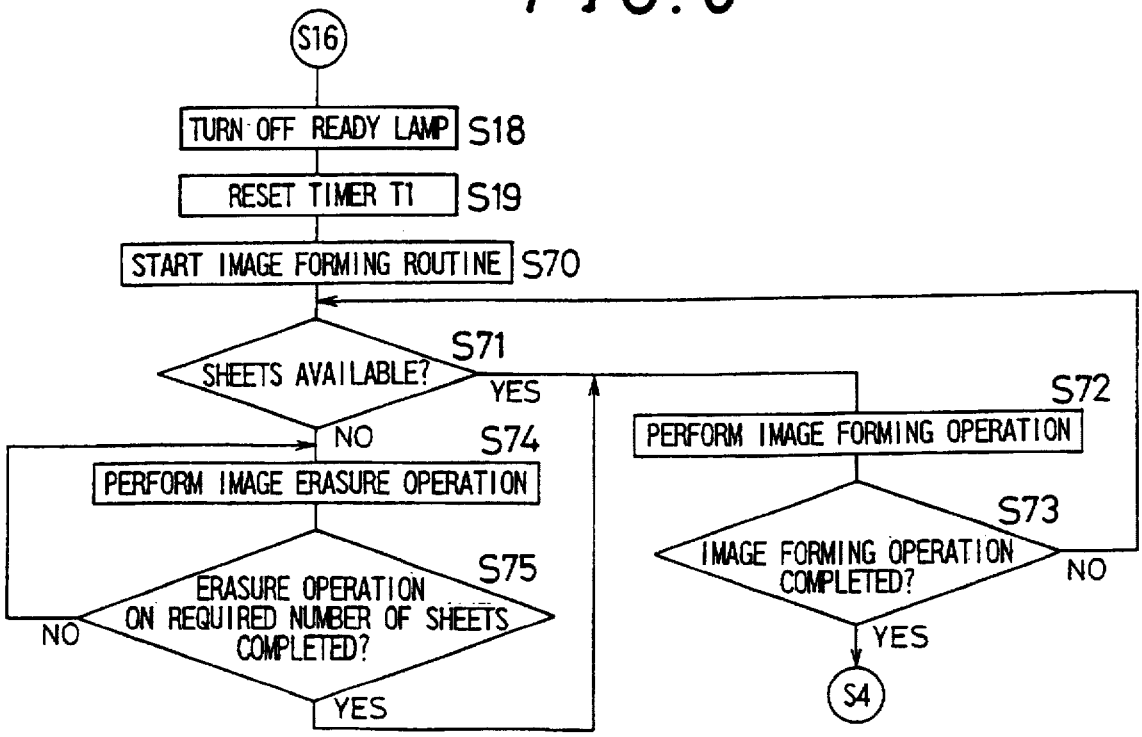
FIG. 8 is a flow chart illustrating control steps of the invention for executing the image erasure operation for continuation of the image forming operation suspended due to running out of sheets.

In case where the sheet feed tray 17 runs out of sheets to feed for the ongoing image forming operation, sheets in the tray for image, erasure 20 may be used. FIG. 8 is a flow chart illustrating an example of the control operation for this purpose.

In FIG. 8, during the execution of the control flow of FIG. 3, an image forming routine is performed in response to the manipulation of the print switch (Step S70). Steps subsequent to Step 70 are specific operations performed in Step S20 of FIG. 3, constituting a control flow according to another mode of the invention.

When the image forming operation is started, the presence of sheets in the sheet feed tray 17 is detected by a sensor 79 (Step S71). If the sheets in the tray 17 are detected, the image forming operation is executed (Step S72) while Steps S73–S71 are repeated until the image forming operation is completed. If the sheet feed tray 17 runs out of sheets during this operation, the control operation proceeds from Step S71 to S74 to start the image erasure operation in order to use sheets in the tray for image erasure 20. At this time, the image forming operation is temporarily suspended. However, the fusing unit 26 is maintained in state ready for the fusing operation.

After it is determined that the toner has been removed from a remaining number of sheets required for the operation (Step S75), the image forming operation is resumed in Step S72. The remaining number can be readily found by subtracting a number of printed sheets from a number specified through the key operation. Thus, after the removal of the toner, the remaining number of sheets are subject to the image forming operation. In this case, the intermediate tray 18 receives the treated sheets so as to sequentially feed the received sheets to resume the image forming operation based on the premise that sheets fed from the sheet feed tray 17 are of the same size with those contained in the tray for image erasure 20.

When the sensor 77 detects no sheet in the intermediate tray 18, a set of operations for the copy production have been completed. At this time, a message indicative of no sheet in the tray 17 may be displayed.

In the mode of practicing the image eraser 50 according to the invention, the treatment for rendering the toner image separable from the sheet is applied for removal of the image. In an embodiment wherein such an image eraser 50 is substituted by irradiation of light of specific wavelength for erasing the toner image, a rise time of the eraser is not required. Accordingly, when the apparatus is placed into the image erasure mode, the power supply to the fusing unit 26 may be shut off or reduced to the preheat level whereby power for driving the light source for the irradiation of light of specific wavelength can be secured.

Subsequently, the printed surface of sheets may be irradiated with the light while the sheets are sequentially fed from the tray for image erasure 20. In this case, the toner image on the sheet is formed of a special toner material. Additionally, the light irradiation can be effected on both sides of the sheet, thus eliminating the need for the sheet to be received by the tray for image erasure 20 with the printed surface down. Furthermore, the toner image on both surfaces of the sheet may be erased simultaneously.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus in which an image formed on a record medium is transferred onto a sheet transported to place and from which the resultant sheet is discharged, the image forming apparatus comprising:

a tray for image erasure for receiving unnecessary copies;

sheet feeding means for feeding the unnecessary copies from the tray for image erasure;

an image eraser for erasing an image, disposed in a passage for transporting the unnecessary copies fed by the sheet feeding means;

idle-period detecting means for detecting a period when the image forming apparatus is idling; and erasure control means in response to a detection signal from the idle-period detecting means, for actuating the image eraser to send the unnecessary copies from the tray for image erasure and execute an image erasure operation.

2. The image forming apparatus of claim 1, wherein the image eraser requires a heat source for the image erasure operation, and the erasure control means responds to a detection signal from the idle-period detecting means to start supplying power to the heat source while reducing power supply to a high-power consuming portion of the image forming apparatus or shutting off power supply generally to the image forming operation.

3. The image forming apparatus of claim 1 or 2, further comprising sheet volume detecting means for detecting a volume of sheets contained in the tray for image erasure, wherein the erasure control means actuates the image eraser only when the detected volume of sheets exceeds a predetermined volume.

4. An image forming apparatus in which an image formed on a record medium is transferred onto a sheet transported to place and from which the resultant sheet out is discharged, the image forming apparatus comprising:

a tray for image erasure for receiving unnecessary copies;

sheet feeding means for feeding unnecessary copies from the tray for image erasure;

an image eraser for erasing an image, disposed in a passage for transporting the unnecessary copies fed by the sheet feeding means; and transport control means for sending unnecessary copies produced during the image forming operation, to the tray for image erasure.

5. The image forming apparatus of claim 4, further comprising sheet detecting means for detecting the presence of a sheet placed on a sheet exit tray provided in the apparatus, wherein after lapse of a predetermined period of detection by the sheet detecting means, sheets on the sheet exit tray may be transferred to the tray for image erasure.

6. The image forming apparatus of claim 1 or 4, wherein the unnecessary copies which were treated by the image eraser will be transferred to a sheet feeding portion capable of feeding sheets, which is provided in the image forming apparatus.

7. The image forming apparatus of claim 6, wherein the sheet seeding portion capable of feeding sheets is an intermediate tray which is used for forming an image on a sheet at least twice, and sheets in the intermediate tray are fed with priority in the image forming operation.

8. The image forming apparatus of claim 7, wherein in the image forming operation, in case where a sheet size specified for the image forming operation matches with that of sheets from which images are to be removed, if the intermediate tray contains any sheet, the sheet in the intermediate tray is fed with priority, and if the intermediate tray contains no sheet, the sheets from which images were removed are directly used for forming images.

9. An image forming apparatus in which an image formed on a record medium is transferred onto a sheet transported to place and from which the resultant sheet out is discharged, the image forming apparatus comprising:

a tray for image erasure for receiving unnecessary copies;

sheet feeding means for feeding the unnecessary copies from the tray for image erasure:

an image eraser for erasing an image, disposed in a passage for transporting the unnecessary copies fed by the sheet feeding means;

an intermediate tray for temporarily receiving a sheet on which an image is formed, to feed the received sheet to an image forming position;

first transport control means for sending sheets from which images were removed by the image eraser, to the intermediate tray; and control means in response to a request of forming an image during the image erasure operation, for starting the image forming operation while allowing the intermediate tray to hold the sheets therein.

10. The image forming apparatus of claim 9, wherein in case where a sheet size specified for the image forming operation is larger than that of sheets from which images were removed by the image eraser, in the intermediate tray, the control means starts the image forming operation while allowing the intermediate tray to hold the sheets therein, the image forming apparatus further comprising second transfer control means for, in case where the sheet size specified for the image forming operation is smaller than that of the sheets from which images were removed, in the intermediate tray, returning the sheets treated by the image eraser to the tray for image erasure.

* * * * *